US006490362B1

(12) United States Patent
Clegg et al.

(10) Patent No.: US 6,490,362 B1
(45) Date of Patent: Dec. 3, 2002

(54) EXTERNAL EAR SPEAKER EAR-HOOK BOOM MICROPHONE

(76) Inventors: Wren Clegg, 103 Meals Dr., Carlisle, PA (US) 17013; Euen Marshall, 4210 S. Salem Church Rd., Dover, PA (US) 17315

( * ) Notice: Subject to any disclaimer, the term of this patent is extended or adjusted under 35 U.S.C. 154(b) by 0 days.

(21) Appl. No.: 09/456,510

(22) Filed: Dec. 8, 1999

Related U.S. Application Data

(63) Continuation-in-part of application No. 09/094,508, filed on Jun. 10, 1998.

(51) Int. Cl.[7] ..... H04R 25/00

(52) U.S. Cl. ..... 381/375; 379/430; 381/381; 381/386; 381/370; 381/374

(58) Field of Search ..... 379/430; 381/329, 381/330, 334, 336, 361, 367, 366, 370, 371, 374, 375, 376, 381, 384, 386; 399/430

(56) References Cited

U.S. PATENT DOCUMENTS

| | | | | | |
|---|---|---|---|---|---|
| 2,882,348 | A | | 4/1959 | Erickson | 381/327 |
| D233,444 | S | | 10/1974 | Christian | D26/14 H |
| 4,453,050 | A | * | 6/1984 | Enokido | |
| 4,748,671 | A | | 5/1988 | Wiegel | 381/169 |
| D309,305 | S | | 7/1990 | von Hall | D14/225 |
| 5,210,792 | A | * | 5/1993 | Kajihara | |
| 5,450,496 | A | * | 9/1995 | Burris | |
| 5,457,751 | A | * | 10/1995 | Such | |
| D371,133 | S | | 6/1996 | Andrea | D14/206 |
| 5,655,026 | A | * | 8/1997 | Peters | |
| 5,715,321 | A | * | 2/1998 | Andrea | |
| 5,729,615 | A | * | 3/1998 | Yang | |
| 5,790,683 | A | * | 8/1998 | Salzani | |
| 5,960,094 | A | * | 9/1999 | Jensen | |

* cited by examiner

*Primary Examiner*—Curtis Kuntz
*Assistant Examiner*—Dionne N. Harvey
(74) *Attorney, Agent, or Firm*—Welsh & Flaxman

(57) ABSTRACT

A head supported communication assembly including a a head support member shaped and dimensioned to conform to the outer periphery of a human ear is disclosed. A speaker is pivotally and releasably secured to the head support member for positioning adjacent the auditory canal of a human ear.

8 Claims, 13 Drawing Sheets

EXTERNAL EAR SPEAKER EAR-HOOK BOOM MICROPHONE

RELATED APPLICATION INFORMATION

This application is a continuation-in-part of U.S. patent application Ser. No. 09/094,508, filed Jun. 10, 1998, entitled "EAR-HOOK BOOM MICROPHONE", which is currently pending.

BACKGROUND OF THE INVENTION

1. Field of the Invention

The invention relates to an ear-hook boom microphone including an external ear speaker. The boom microphone hooks around a user's ear to allow for hands-free communication.

2. Description of the Prior Art

Conventional citizen band (CB) radios, often used in motor vehicles, are hand operated units with a handheld microphone. As the number of vehicles on the road increases each day, it is critical that drivers stay focused on driving and keep both hands on the steering wheel. Those familiar with driving in traffic can appreciate that it is difficult and dangerous for the driver to be constantly reaching down to their CB unit to retrieve the handheld microphone. Various devices have been proposed to facilitate a solution to this problem, but such devices have not proved completely satisfactory.

Current ear-hanging headsets are generally a unitary piece of metal or plastic having a microphone element placed at the end of a boom, or extension, proximate the user's mouth. However, these prior art units fail to address some basic problems including, but not limited to, ambient noise interference and the use of microphone headsets with eyeglasses.

As ambient noise from the surrounding environment is picked up by the microphone, the clarity of the conversation is reduced. Currently, microphone elements are simply attached to the end of the boom and are covered by a foam shield to minimize the ambient noise. This design is only partially effective in reducing ambient noise.

Further, the current ear-hanging headsets are designed with a solid curved piece shaped to conform to the pinna of a human ear and fail to provide any accommodation to users that wear eyeglasses (i.e., prescription glasses, sunglasses, etc.). The curved pieces are usually built to provide adequate strength and support and are, therefore, made from rigid materials. As such, it is difficult for a user to wear these conventional headsets in connection with their eyeglasses. In one instance, the frames of the eyeglasses must lay on top of the rigid material which causes improper optical alignment for the user. Alternately, the frame must be sandwiched next to the rigid material and in the small space between the user's ear and the user's head. This may cause irritable rubbing and may become very painful and annoying.

In addition to the discomfort associated with supporting a boom microphone on a user's ear, prior microphones have attempted to include a speaker adjacent the user's auditory canal. For example, U.S. Pat. No. 5,715,321, to Andrea et al., discloses a headset with a speaker positioned adjacent the user's auditory canal. In fact, the speaker is designed to sit directly against the ear and the auditory canal. This creates undesirable pressure around the user's ear.

The positioning of the speaker on the ear adjacent the auditory canal covers the auditory canal and is designed to provide a maximum auditory output to the listener. The design is specifically constructed to limit the entry of surrounding noises to the auditory canal. As a result, momentary, unexpected changes in the output volume may be highly distracting, and sometimes painful, to the user. The construction of the speaker makes it difficult to adjust the speaker for quickly relieving the user of the distracting sound.

In fact, it is the industry standard to place the mobile speaker either directly against the ear and the auditory canal, or place a receiver attached tube directly into the auditory (ear) canal. These methods are very old, totally unnecessary and even hazardous. It is illegal in many states and municipalities to cover either ear in any way when operating a motor vehicle. Covering the ear or plugging the ear canal limits dramatically the ability to hear surrounding noises, including horns, sirens and other warning devices.

Not only does covering the ear reduce hearing, but it also creates an "ocean", or hollow, sound. As a result, users of some prior art headsets experience a competition between internal body sounds and external surrounding sounds. This competition significantly lessens the hearing ability of a person wearing a headset.

In addition to the undesirable position of the speaker on the user's ear, the apparatus disclosed in the '321 patent, as well as similar designs found in the prior art, include a speaker which is integrally formed with the headset. The speaker is, therefore, an irreplaceable part of the apparatus and the user is stuck with the speaker whether it is desired or not.

A need therefore exists for an ear mounted boom assembly including a speaker overcoming the shortcoming of prior art apparatuses. The present invention provides such an ear mounted boom assembly with an external ear speaker.

SUMMARY OF THE INVENTION

It is, therefore, an object of the present invention to provide a novel ear-hook microphone device that can accommodate a variety of users while increasing audio detection.

It is a further object of the present invention to provide an ear hook microphone device including a pivotally and releasably mounted external ear speaker.

In one embodiment, an ear-hook microphone is comprised of a hollow angled tubular housing, a boom extension and an ear-hook. The housing being formed at a 90 degree angle defines first and second legs which receive a microphone element. The boom connects the housing to the ear-hook allowing the housing to be placed proximal the user's mouth. The ear-hook includes an inner side shaped and dimensioned to conform to the outer periphery of the pinna of a human ear providing support for the device.

In another embodiment, the microphone housing is rotatably secured to the boom allowing the device to be positioned over the right or left ear of a user.

In another embodiment, the headset device is formed from separate elements connected together. Specifically, the housing includes a portion that is sized to provide a secure friction fit within the internal diameter of one end of the boom. At the opposite end, the boom includes an opening sized to securely accommodate an end of the ear-hook.

In another embodiment, the microphone includes a novel housing which contains a microphone element and an associated microphone cord. The housing is in the form of a 90 degree angled tube with first and second legs having first and second ends. The housing includes a microphone element seat in the first leg for maintaining the relative positioning of the microphone element within the housing. Further, four voice entry ports are located, at approximately 90 degree intervals around the circumference of the housing, between the location of the element seat and the housing apex. The housing includes various internal barriers sized to reduce ambient noise. The housing is formed in two halves which are hinged together and include a latching means allowing for opening and closing of the housing to enable replacement of the microphone element if necessary.

In another embodiment, the housing includes a plurality of fins, each positioned on opposite sides of the outside of the first leg of the housing, for assisting in maintaining an open cell foam wind screen on the unattached end of the first leg of the housing.

In an alternate embodiment, the ear-hook incorporates a recess formed on the outer side which is sufficiently sized and positioned so as to be capable of receiving an eyeglass frame. This enables a user, who is wearing eyeglasses, to wear the ear-hook with the eyeglasses frames being received in the recess.

In another embodiment, the ear-hook includes an auditory canal seat formed in an inner side of the ear-hook, sized and positioned so as to provide a secure fit between the ear-hook and the auditory meatus of a user's ear.

In an alternate embodiment, the ear-hook includes an auditory canal seat adapter enabling adjustment in size of the ear-hook depending on the varying sizes of different user ears.

In another embodiment, the ear-hook is formed as two distinct pieces detachably secured to one another.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
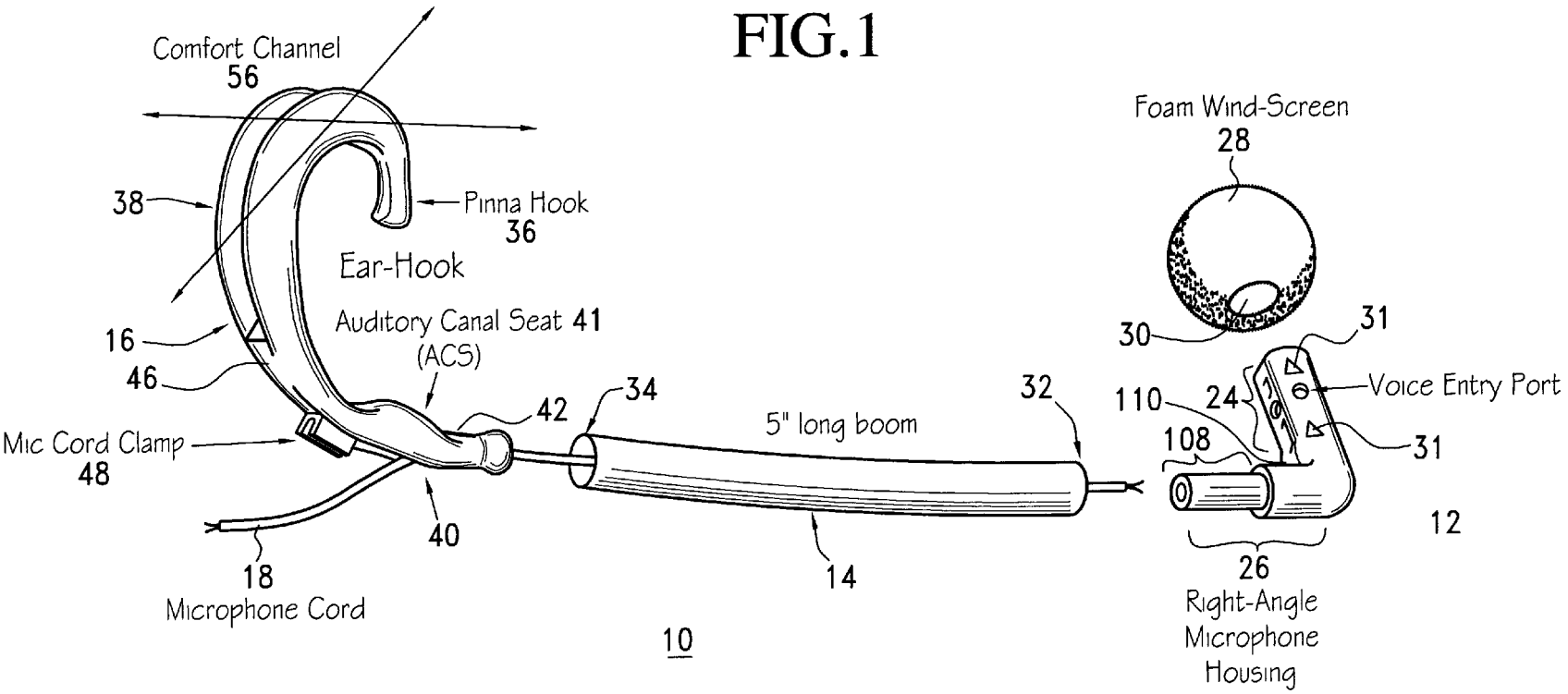
FIG. 1 is a fragmentary exploded view embodying the present invention.
Figure 3:
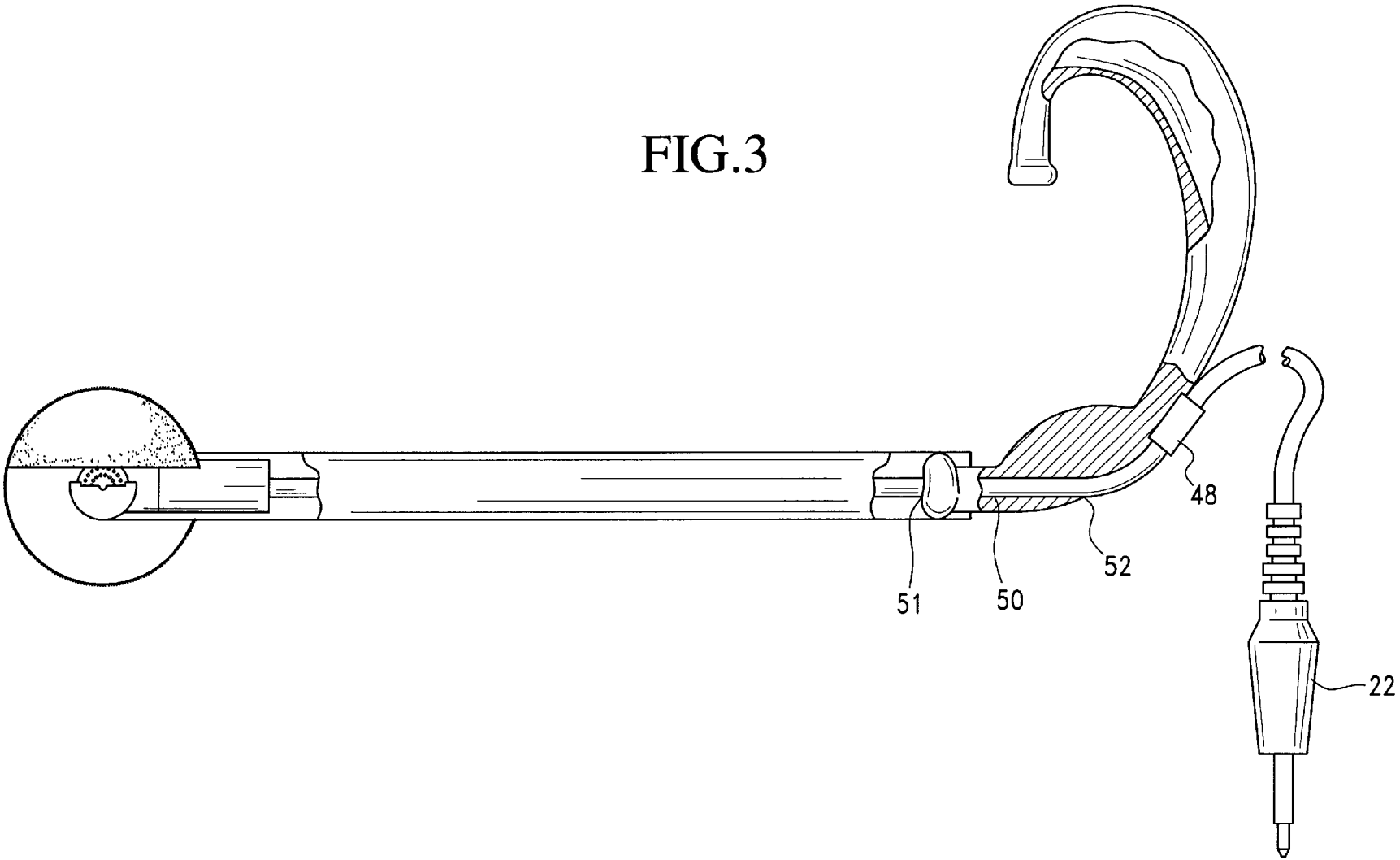
FIG. 3 is an elevation view, partly broken away to show the details of construction of one embodiment of the present invention.
Figure 4:
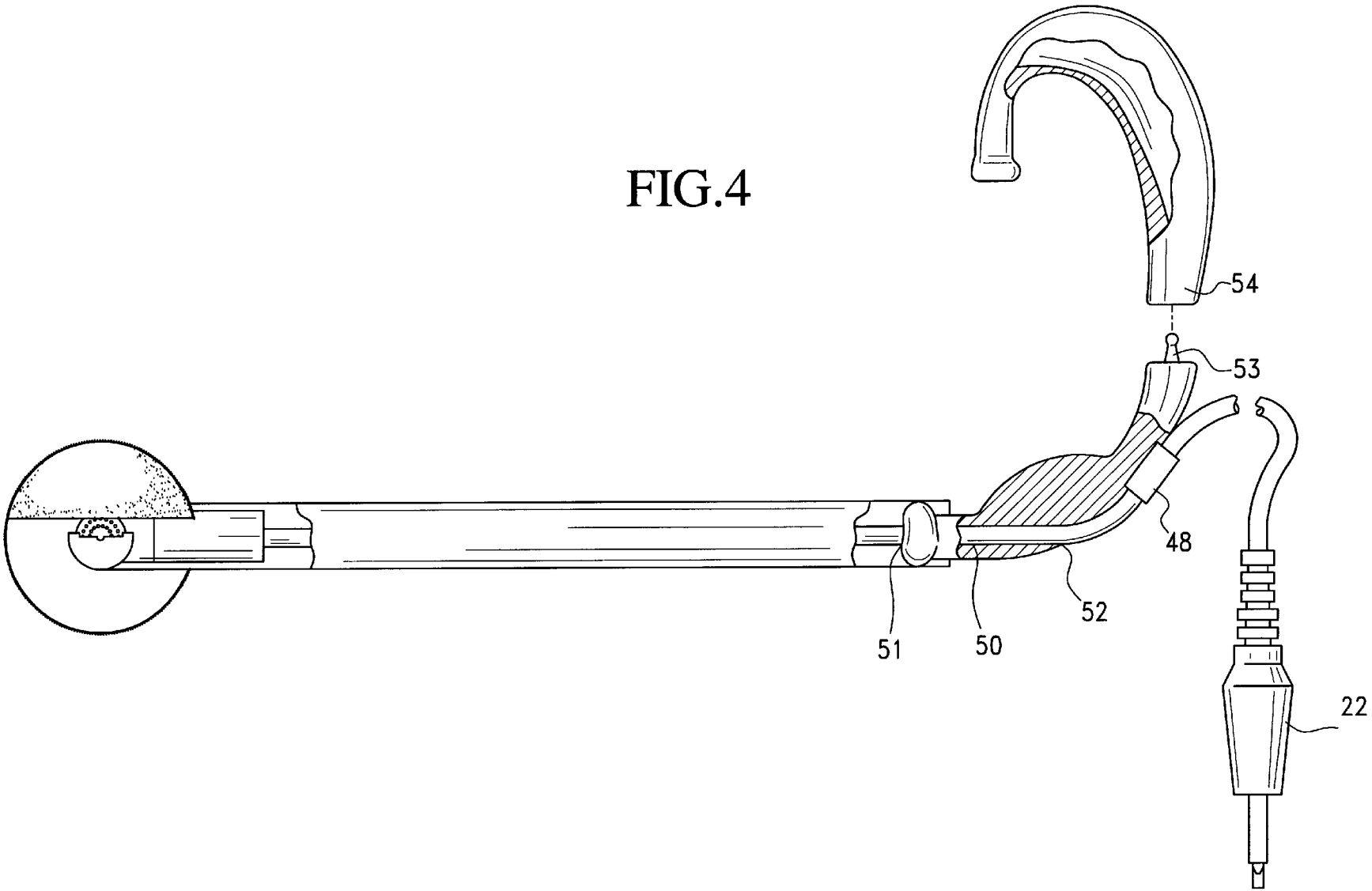
FIG. 4 is an elevation view, partly broken away to show the details of construction of an alternative embodiment of present invention.

With reference to FIGS. 1, 3 and 4, an ear-hook boom microphone device 10 is illustrated in three distinct sections including a microphone element housing 12, an elongated boom 14 and an ear-hook 16. A microphone cord 18 of sufficient length runs from a microphone element 20 positioned inside the housing 12, through the boom 14 to the ear-hook 16 and connects to an associated audio in port (not shown) via a plug 22. Though three distinct sections have been disclosed, the device can be formed as a unitary piece or in any number of segments without departing from the spirit of the invention. The device can also be used with a cordless microphone element or with the cord extending out through other ports in the system (not shown).

The housing 12, boom 14 and ear-hook 16 sections are made from injection molded plastic. The boom 14 is made from a pliable material that allows the user to bend or adjust the device for maximum comfort and operation. The weight of the boom microphone is a high priority, and must remain extremely light since it does not utilize a head-band over the user's head for stability. As such, plastic is the preferred material used to make the boom microphone because it is inherently durable, however, other materials can be used without departing from the scope of the invention.

As illustrated, the housing 12 is shaped substantially as a right angle tubular piece wherein the legs of the right angle are designated as a first leg 24 and a second leg 26. In one illustrative embodiment, a portion of the first leg 24 is covered by a foam wind screen 28.

The foam wind screen 28 is selected from standard open cell foam material ensuring that the material does not substantially interfere with sounds directed into the housing 12. The foam wind screen 28 is formed as a unitary piece with a cavity 30 positioned in its surface. The cavity 30 is sized to accept the first leg 24 of the housing 12 while forming a secure friction fit over the first leg 24. This reduces the ambient noise reaching the microphone element 20 while preventing the foam wind screen 28 from coming loose. To assist in maintaining the foam wind screen 28 in place, two pairs of fins 31 are formed on the outer surface of the first leg 24 of the housing 12. Each of the pair of fins 31 is formed on an opposite side of the housing 12 and the individual fins are longitudinally spaced along the first leg 24 to provide adequate grasping of the foam wind screen 28. The fins 31 can be formed in varying shapes including, but not limited to, multi-sided pyramids, barbs and hooks so long as the fins 31 assist in maintaining the foam wind screen 28.

The elongated boom 14 is formed as a hollow tubular member generally five inches in length having a proximal end 32 and a distal end 34. While the boom 14 is disclosed as a hollow tubular member to accommodate the microphone cord 18, the boom 14 could be constructed or molded as a solid piece with the microphone cord 18 affixed within the mold without departing from the spirit of the invention. The boom also can be formed without any consideration for a microphone cord if a wireless element is employed or if the cord exits the housing 12 at any other location. It is also possible to vary the length of the boom 14 to accommodate different users.

In the illustrative embodiment, a portion of the second leg 26 of the housing 12 has an outer diameter sized to frictionally fit within the inner diameter of the boom 14.

The ear-hook piece 16 is formed from a support member sized and shaped to be conformable to the outer periphery of a human earls pinna. Specifically, the ear-hook piece 16 is designed with an upper piece or pinna hook 36 that starts from a position partially in front of the upper area of the ear concha. The ear-hook 16 continues into a mid-section 38 forming a loop around the pinna and advancing to a lower end 40 which extends adjacent to the earlobe. This design for the ear-hook 16 provides increased comfort allowing the user to wear the ear-hook headset 10 for longer periods of time than allowed by previous ear-hook type headsets.

Positioned adjacent the lower end 40, at a point that would be approximately beneath the auditory meatus or auditory canal of the user's ear and on the inner side 42 of the ear-hook 16, is a rise or auditory canal seat 44 for contacting the ear. The auditory canal seat 44 is shaped and positioned to increase surface contact between the ear and the ear-hook 16. Further, this arrangement assures a more secure fit while reducing the likelihood of the housing 12 moving out of position. Also, the auditory canal seat 44 reduces potential ear irritation by preventing the ear-hook 16 from rubbing or sliding around.

On the outer side 46 of the ear-hook 16, approximately opposite the auditory canal seat 44, is a microphone cord clamp 48. The microphone cord clamp 48 is in the form of a channel sized to provide a secure friction fit for the microphone cord 18. It should be noted that there are alternative positions along the ear-hook 16 where the microphone cord clamp 48 can be placed without departing from the spirit of the invention.

The ear-hook 16 also incorporates a passageway 50 sized to accommodate the microphone cord 18. The passageway has two spaced apart openings 51 and 52 providing an entrance and exit for the microphone cord 18 to be admitted to the passageway 50. Further, the passageway 50 extends from the lower end 40 at opening 51 up to opening 52, a point proximate, but not exceeding, the microphone cord clamp 48. In an illustrative embodiment, the passageway 50 is a bore of sufficient diameter to pass the microphone cord 18 therethrough. The microphone cord clamp 48 and the passageway 50 prevent the microphone cord 18 from getting in the user's way by providing for attaching behind the user's ear.

The lower end 40 of the ear-hook 16 and the inner diameter of the boom 14 are sized to form a friction fit connection as previously discussed with regard to the connection of the housing to the boom. Further, the lower end 40 is telescopically fitted inside the distal end 34 of the boom 14 in a similar fashion as the housing 12 and aligned such that the passageway 50 and opening 51 are positioned within the boom 14 to receive the microphone cord 18. However, it should be noted that other connections can be fashioned between these two sections so long as the proper alignment is maintained.

Further, while the ear-hook 16 and boom 14 have been described as two separate pieces, they can be formed as a single integral unit, shaped to conform and be supported by the pinna while extending outwardly from the user's face and mouth. Alternately, the ear-hook 16 can be formed of multiple segments providing for interchangeable piece construction. Alternately, FIG. 4 illustrates a pin 53 positioned in the lower piece of the ear-hook 16 and a pin receiving means 54 positioned in the upper piece of the ear-hook 16. The pin 53 and the pin receiving means 54 are sized accordingly to provide a pivotal engagement between upper and lower pieces of the ear-hook 16. Specifically, the pivotal engagement is limited to movement, between the upper piece lower piece of the ear-hook 16, in one planar direction. This permits the upper piece to hinge back and forth allowing for use of the ear-hook 16 with users having ears of different sizes. In one preferred embodiment, the hinging of the upper piece with respect to the lower piece has a maximum range of 10 degrees forwards or backwards off the vertical axis.

Another feature of the ear-hook 16 is a recess 56. The recess 56, positioned in the outer side 46 of the ear-hook 16, extends from a position adjacent the pinna hook 36 at the top portion above a user's ear. Further, the recess 56 tapers off at a point before the microphone cord clamp 48. The recess 56 acts as a comfort channel sized to accommodate the frame or ear portion 58 of a standard pair of eyeglasses without interfering with the normal positioning of the eyeglass frames 58 on the user's body.

While multiple sections of the device 10 have been disclosed as being secured to one another by telescopic friction fitting or alternative methods, the rotational movement of each of the elements, with respect to each other, is unrestricted. Therefore, the housing 12 can rotate, while secured to the boom 14, allowing the device 10 to be used with either the right or left ear.

Figure 2:
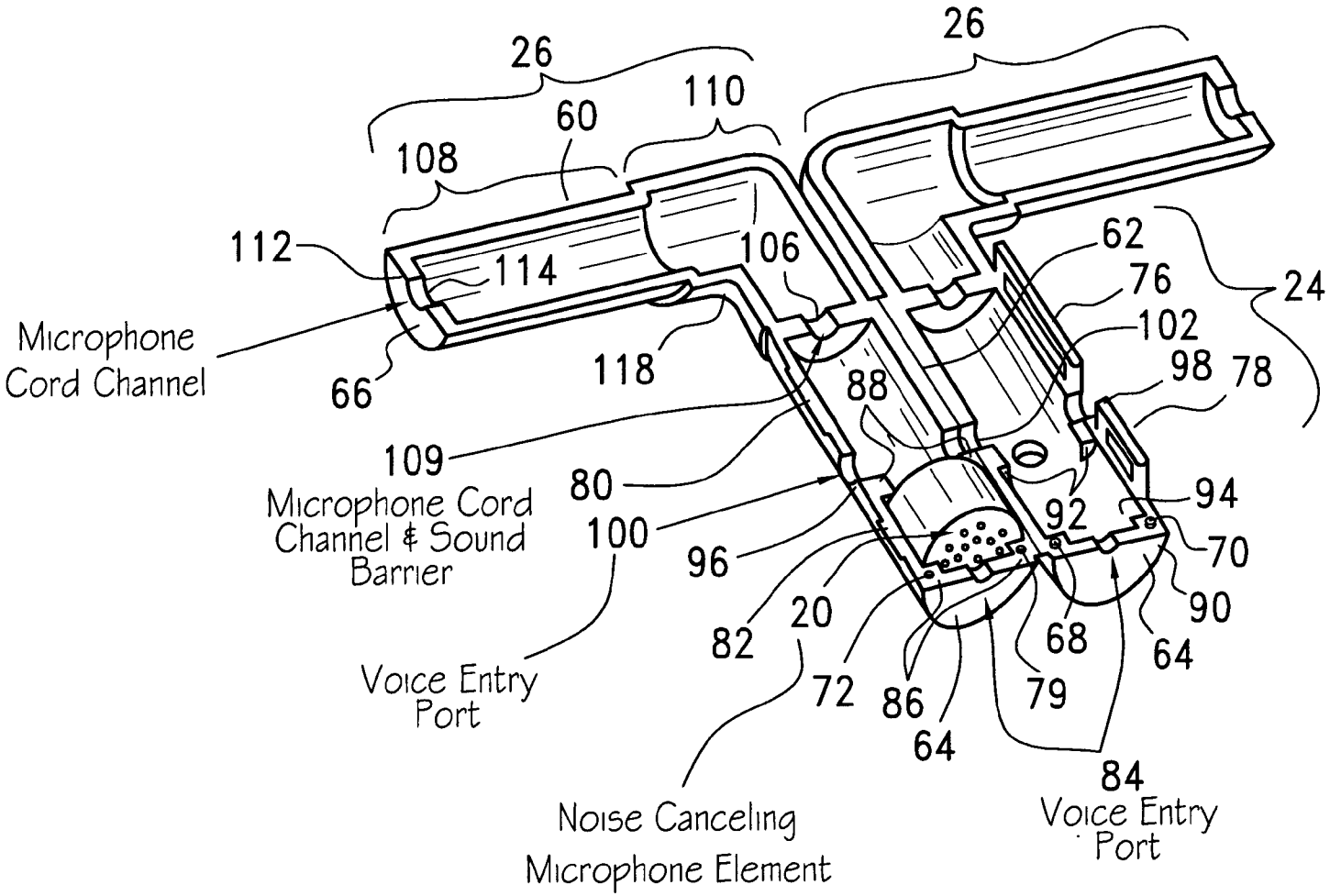
FIG. 2 is a perspective view of the entire housing with a microphone element positioned within.

FIG. 2 is illustrative of the microphone element housing 12. The housing 12 is formed as two halves wherein the inner portion of each half is substantially a mirror images of the other.

The housing 12 is viewed as being in a closed position when the halves are folded along an axis seam or hinge area 62. In its closed position, the housing 12 forms a unitary tubular structure with an angle, of approximately 90 degrees, having an apex in the mid-region which defines the first and second legs 24, 26. The tubular structure is partially closed off at its two defined ends, wherein a first end 64 is located in the first leg 24 and a second end 66 is located in the second leg 26. In a preferred embodiment, the length of the housing measured from either of the two ends 64 or 66, to the apex inner portion 118 is approximately 0.75 inches (0.191 centimeters). Further, the radius (R) of the external portion of the tubular housing 12 is approximately 0.1565 inches (0.3975 centimeters). The cavity 30 positioned in the foam wind screen 28 is approximately 0.75 inches (0.191 centimeters) deep having a radius of 0.3 inches (0.76 centimeters) to securely accommodate the first leg 24.

Within the housing 12, a pair of posts 68, 70, and respectively positioned post receiving holes 72, 74, are positioned in a lip 60 at the first end 64. Further, these associated pairs of posts 68, 70 and post receiving holes 72, 74 are formed on opposite sides of the tubular halves at the first end. This arrangement, between the posts and holes, provides maximum alignment and a secure closure of the tubular housing 12 and maintaining the precision noise canceling capability of the housing 12.

To assist in maintaining the secure closure of the housing 12, a pair of latches 76, 78 are also provided. Each of the pair of latches 76, 78 is formed along or adjacent, and extends from, the lip 60 of one of the halves. Further, each of the latches 76, 78 connects to a respectively positioned latch receiver 80, 82 on the other open half when the housing 12 is in its closed position. In the illustrative embodiment, the latches 76, 78 are formed in the first leg 24 of the housing 12 and are positioned on the same side of the open housing 12. The latch receivers 80, 82 are also formed in the first leg 24 of the housing 12 and are positioned on the same side of the open housing as each other, but opposite the latches 76, 78. The importance of this latch arrangement is to allow for replacement of the microphone element 20, if need be, without having to replace the entire ear-hook boom microphone device.

While two pairs of each of the posts, holes, latches and receivers are disclosed, alternative numbers of pairs with differing relative positions and different types of connections could be used to align and secure the housing 12 in a closed position without departing from the spirit of the invention.

To provide a way for audible sounds to be picked up by the microphone element 20, the housing 12 has a first voice entry port 84 located in the center of the first end 64 of the housing 12 where the foam wind-screen 28 is to be positioned. As shown in FIG. 2, the first voice entry port 84 appears as a cutout semicircle in the edge formed at the first end 64 in each of the two halves. In an illustrative embodiment, the first voice entry port has a radius (R) of approximately 0.019 inches (0.048 centimeters).

Inside each of the halves of the housing 12 are two pairs of projections 86, 88, 90 and 92. The arrangement of these projections form a seat 94 for the microphone element 20 when positioned therein. In one illustrative embodiment, one half of the first leg 24 of the housing 12 has the first pair of projections 86 located closest to the first end while the second pair of projections 88 is positioned away from the first pair of projections 86 by a distance sufficiently sized to receive and maintain a secure fit on the microphone element 20. To establish optimal noise reduction, the seat 94 is sized to have a width of 0.135 inches (0.342 centimeters) as measured between the first pair of projections 86 and the second pair of projections 88. Further, the seat 94 is optimally placed within the housing 12 to enhance the noise reduction properties of the housing arrangement.

The third pair 90 and the fourth pair 92 of projections are positioned in the other half of the open housing 12, opposite the first and second pairs of projections 86, 88, and form the other half of the securing seat 94 when the housing is closed. As with the first and second pairs of projections 86, 88, the third and fourth pairs of projections 90, 92 are spaced 0.135 inches (0.343 centimeters apart.

In order to provide optimal clarity and reception of a user's voice, four voice entry ports, 96, 98, 100 and 102 circumscribe the tubular housing 12 and are positioned equidistant downstream from the seat 94 towards the apex.

Further, the voice entry ports 96, 98, 100 and 102 are formed and positioned substantially in 90 degree intervals around the circumference of the tubular housing. Two of the voice entry ports 96, 98 are formed in the middle of each of the open halves while the other two voice entry ports 100, 102 are formed as semicircles in the lip 60 and seam 62 such that when the housing 12 is placed in a closed position, the voice entry ports 100, 102 are formed. In an illustrative embodiment, each of the voice entry ports is formed as a circle having a radius (R) of 0.035 inches (0.089 centimeters).

The relative positioning and sizes of the voice entry ports 96, 98, 100 and 102 circumscribing the tubular housing 12 is calculated to provide for maximum noise impedance. Specifically, any changes in the positioning of these four voice entry ports or the voice entry port at the end of the housing will dramatically change the noise canceling and modulation characteristics of the completed housing 12.

Further, the placement of the microphone element 20 within the housing 12 is at a precise location gauged to achieve optimal background noise reduction while maintaining voice clarity in a single or unidirectional voice pattern. The microphone element 20 will only pick up or hear in the direction that the housing 12 is pointed at the end of the boom 14.

A first microphone cord channel or first sound barrier 104 is positioned downstream from the four voice entry ports 96, 98, 100 and 102 towards the apex. The first sound barrier 104 is formed with a first aperture opening 106 sized to provide a tight seal on the microphone cord 18. In an illustrative embodiment, the first aperture opening 106 is formed as a circle having a radius of 0.049 inches (0.124 centimeters). This is accomplished by forming the first aperture opening 106 out of two solid semicircle pieces, each positioned in a half of the tubular housing 12. Further, the semicircle pieces are formed with small semicircles removed from the center of the diameter line. By aligning the semicircle pieces within the halves such that when the housing 12 is closed, the first aperture opening 106, has a diameter just smaller than the diameter of the outer insulation sheath of the microphone cord 18. This arrangement improves reception of the microphone element 20 by minimizing the detection of interfering external noises not directed into a voice port.

While multiple distinct elements have been disclosed in the housing, the housing is formed by simple injection molding of plastic with the aforementioned elements being formed from the mold as part of the housing structure.

The second leg 26 of the housing 12 is divided into a distal portion 108 and a proximal portion 110 relative to the apex in the housing 12. The distal portion 108 has an approximate length of between 0.625 inches (1.588 centimeters) and 2.500 inches (6.352 centimeters), while the proximal portion 110 has an approximate length of 0.125 inches (0.318 centimeters). Further, the distal portion 108 is of lesser internal and external diameter than the proximal portion 110 having an internal diameter of 0.160 inches (0.410 centimeters) and an external diameter of 0.234 inches (0.594 centimeters). Furthermore, the outer diameter of the distal portion 108 is approximately the same as the inner diameter of the boom 14. This configuration provides a secure friction fit between the housing 12 and the boom 14. Also, the outer diameter of the proximal portion 110 is approximately the same as the outer diameter of the boom 14 providing a flush external fit between the outer diameters of the boom 14 and housing 12 when they are connected. Such a firm fit between these components prevents inadvertent detachment while allowing for easy assembly. Alternately, if a piece is damaged or the microphone element needs to be replaced, friction fit connections allow the user to disassemble the device, repair or replace the damaged portion and reassemble the device with ease.

A second microphone cord channel or second sound barrier 112 is located at the second end 66 of the housing 12. The second sound barrier 112 is formed with a second aperture opening 114 sized to provide a tight seal on the microphone cord 18. In an illustrative embodiment, the second aperture opening 114 is formed as a circle having a radius of 0.049 inches (0.124 centimeters). This is accomplished by forming the second aperture opening 114 in the same manner as the first aperture opening 106 wherein two solid semicircle pieces are each positioned in a half of the tubular housing 12. Further, the semicircle pieces are formed with small semicircles removed from the center of the diameter line. The semicircle pieces are aligned within the halves such that when the housing 12 is closed, the second aperture opening 114, having a diameter just smaller than the diameter of the outer insulation sheath of the microphone cord 18, is formed. In as much as the first sound barrier 104, the second sound barrier 112 prevents unwanted extraneous noise from reaching the microphone element 20.

Figure 5:
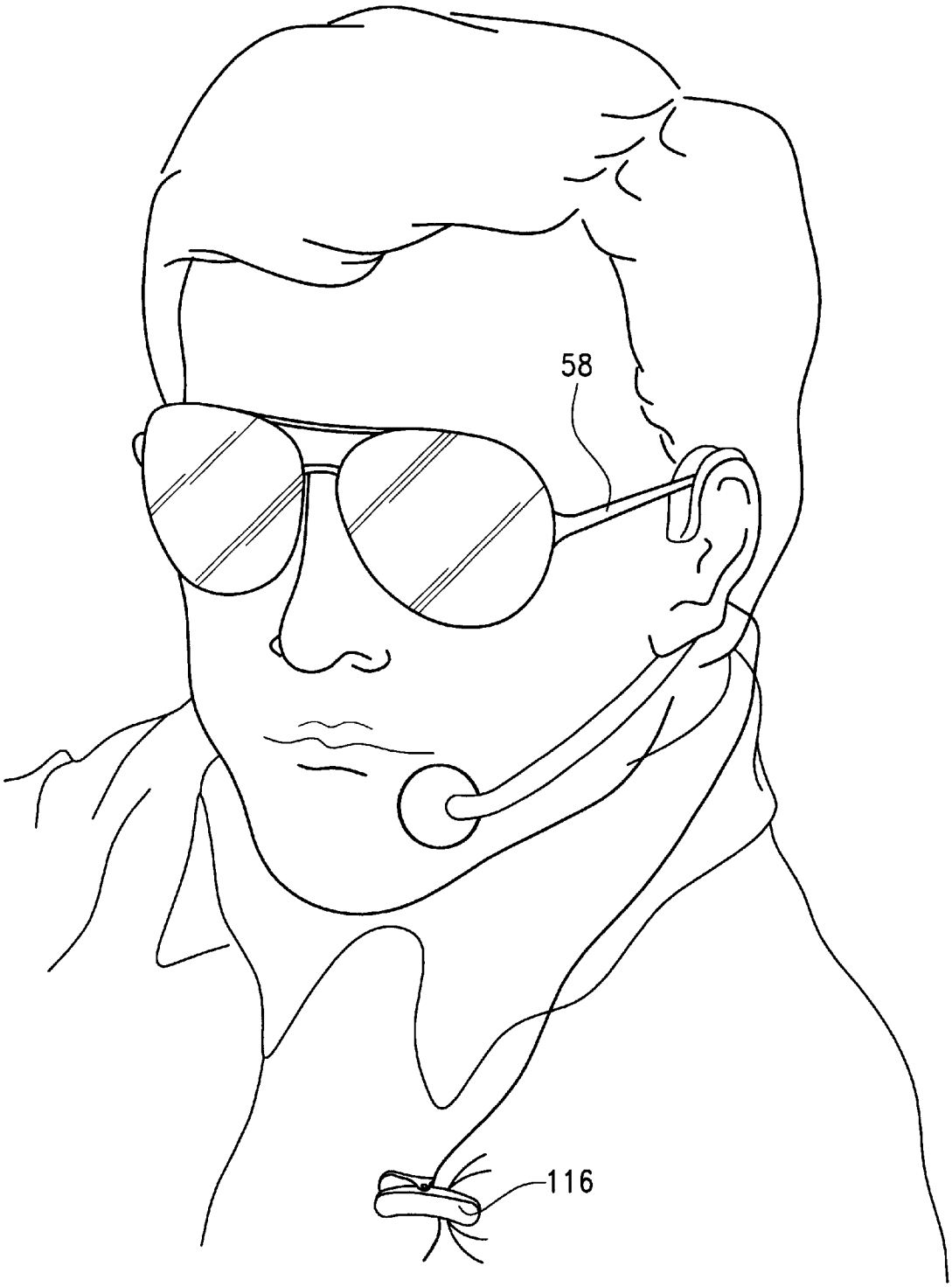
FIG. 5 is a perspective view of the present invention in use.

FIG. 5 illustrates the ear-hook boom microphone device in use. As shown, the user is wearing eyeglasses wherein the frame and ear portion of the eyeglasses is accommodated by the recess 56 in the ear-hook. Further, a microphone cord clip 116 is used to prevent the cord 18 from getting tangled with the user. This is an important safety device for anyone using the device 10 while operating machinery to prevent the microphone cord 18 from getting tangled with the machinery. Also, this may prevent the cord 18 from getting caught on something and causing the device 10 to get pulled off the user's head and get damaged.

Figure 7:
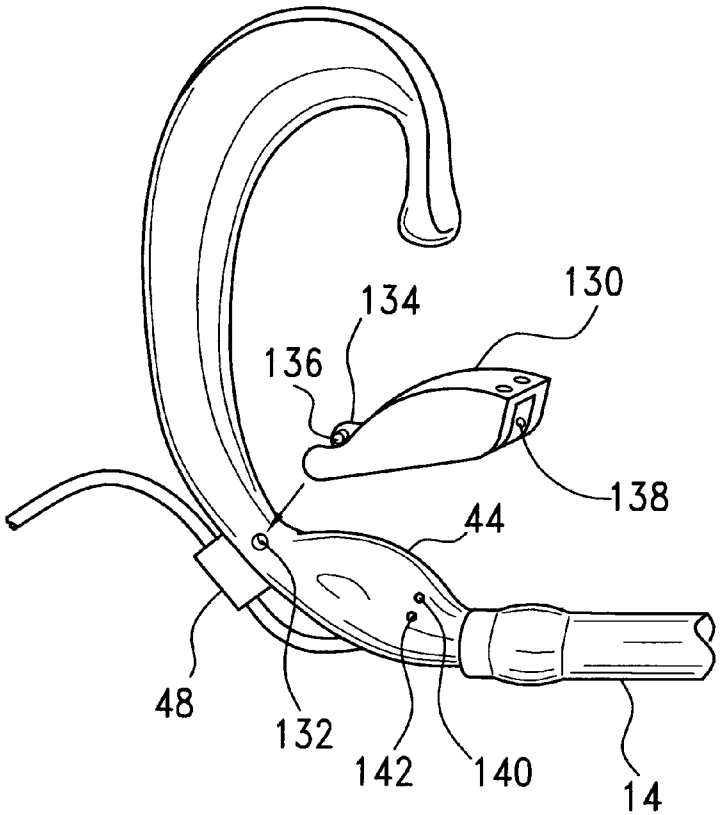
FIG. 7 is a front left side exploded view of the ear-hook shown in FIG. 6.
Figure 6:
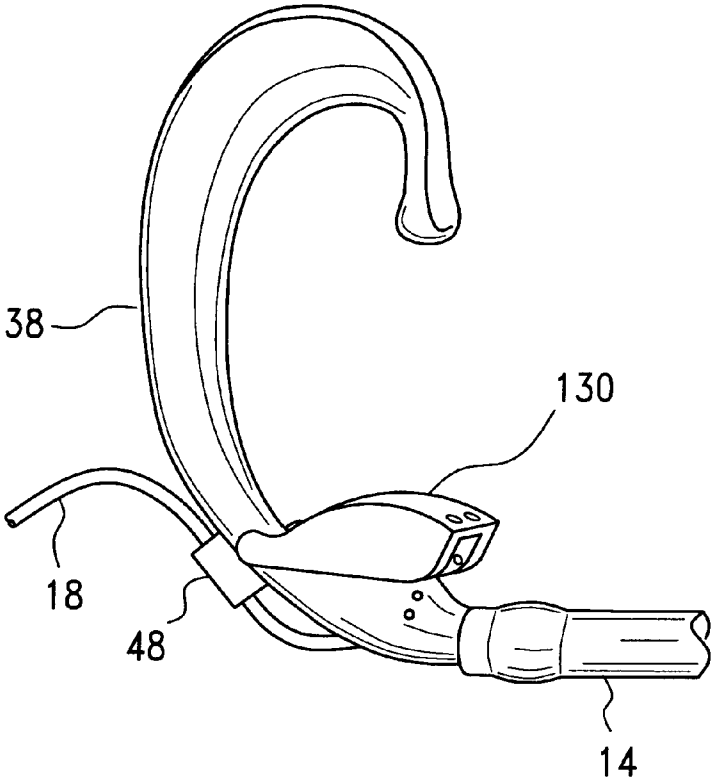
FIG. 6 is a front left side perspective view of the ear-hook including an alternative embodiment of the present invention.

In an alternative embodiment, FIG. 6 illustrates the auditory canal seat 44 with an auditory canal seat adapter 130 removably positioned over top. The auditory canal seat adapter 130 is a removable attachment, formed with a recess sized to accept the auditory canal seat 44, which clips into a pair of holes 132 formed in the ear-hook 16. As illustrated in FIG. 7, the holes 136 are positioned on each side of the ear-hook 16. The auditory canal seat adapter 130 includes a pair of extensions 134 which are spaced apart approximately the same dimension as the width of the ear-hook 16 at the position of the holes 132. The pair of extensions 134 include a pair of pins 136 with one on each extension and sized to securely fit in the holes 132 on the ear-hook 16. This arrangement allows the auditory canal seat adapter 130 to be clipped onto the ear-hook 16 and freely swing down to a resting position over top of the auditory canal seat 44 accommodating a person with very small ears.

The auditory canal seat adapter 130 includes a pair of molded notches 138, formed on opposite sides inside of the auditory canal seat adapter 130, provide further adjustment of the relative positioning of the auditory canal seat adapter 130. Upon swinging the auditory canal seat adapter 130 down over the auditory canal seat 44, the molded notches 138 can be snapped into one of several receiving holes 140, 142 positioned on each side of the auditory canal seat 44. The receiving holes 140 and 142 are spaced along the swing path of the auditory canal seat adapter molded notches 138 allowing for locking of the adapter 130 in various selected heights with respect to the auditory canal seat 44 and thereby increasing the comfort fit for the user. Though three auditory canal seat adapter positions have been disclosed: resting the auditory canal seat adapter 130 on the auditory canal seat 44, and the two selected heights, multiple more positions can be designed without departing from the spirit of the invention.

Figure 8:
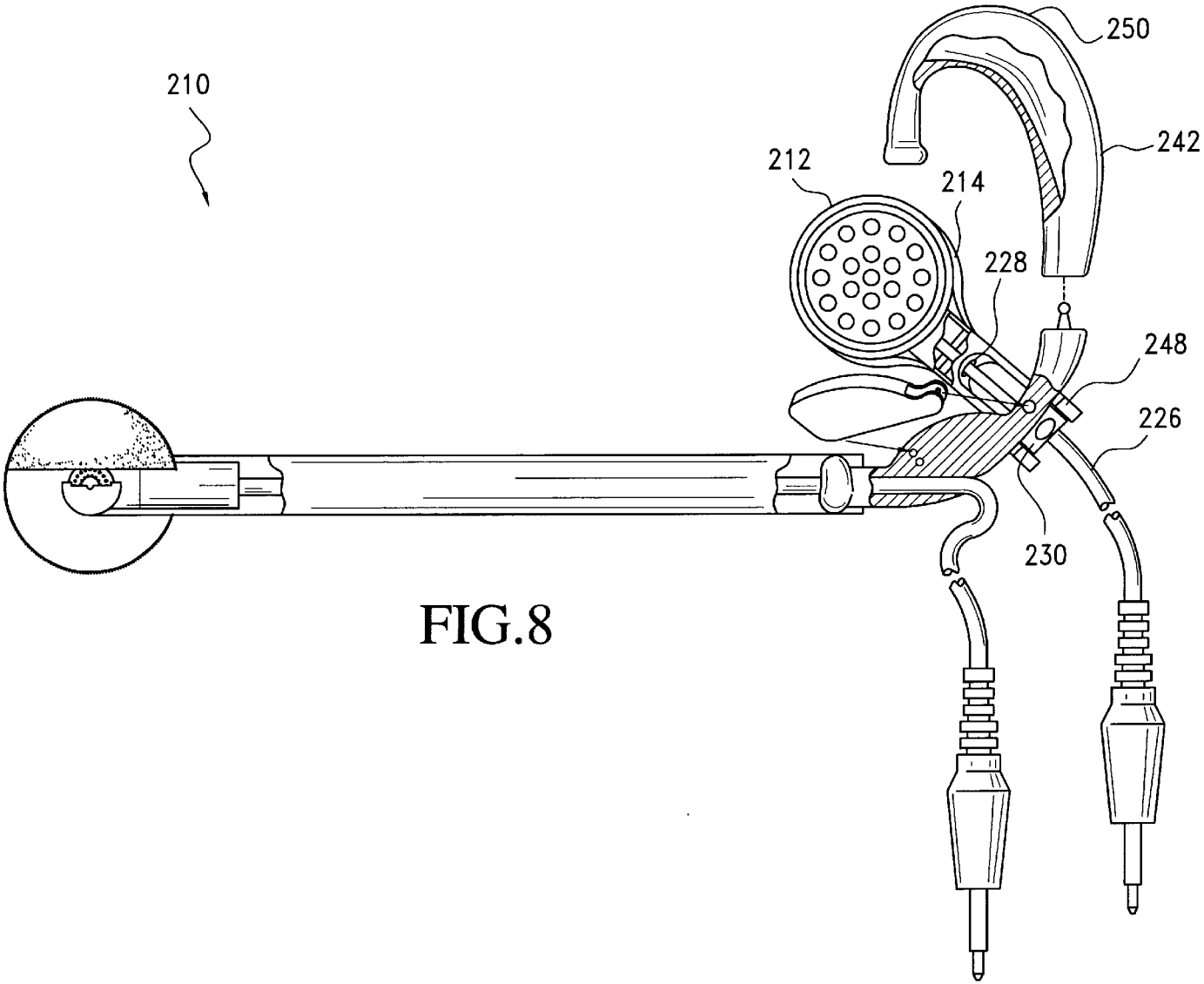
FIG. 8 is a further embodiment of the boom microphone device as disclosed in FIG. 4 with an external ear speaker.
Figure 9:
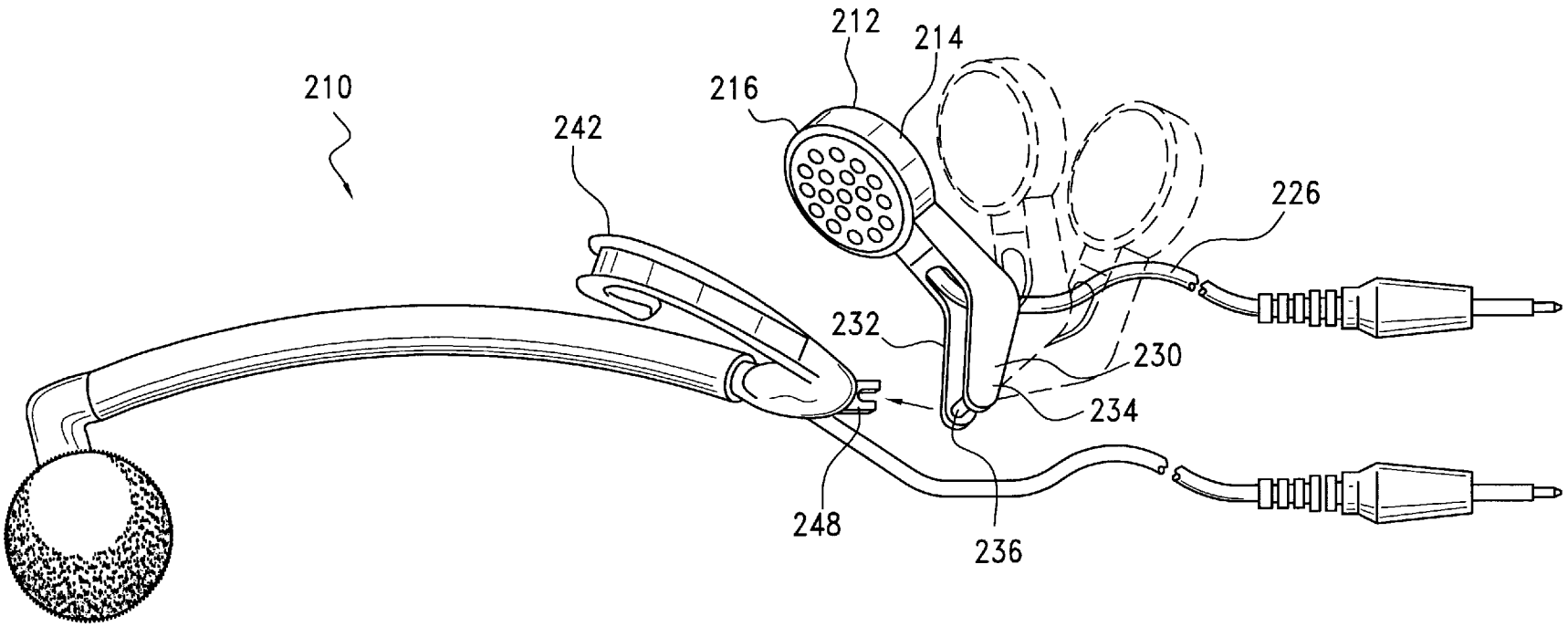
FIG. 9 is a exploded perspective view of the boom microphone device disclosed in FIG. 8 with an external ear speaker.
Figure 13:
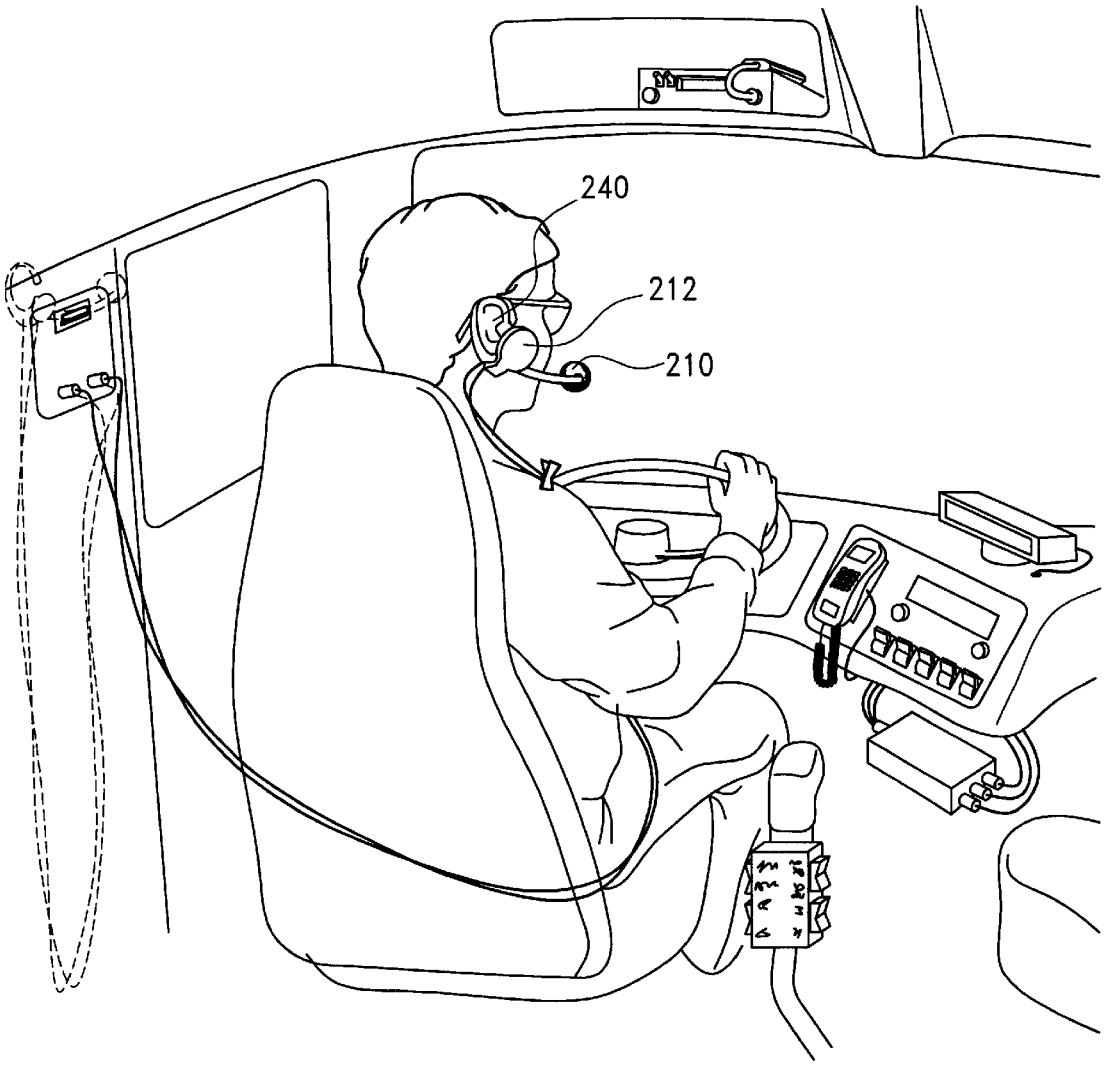
FIG. 13 is a perspective view of the boom microphone device disclosed in FIG. 8.

A further embodiment of the boom microphone device is disclosed in FIGS. 8, 9 and 13. The boom microphone device 210 is substantially identical to the boom microphone devices discussed above with reference to FIGS. 1–7 and includes an external ear speaker 212. The external ear speaker 212 is pivotally and releasably mounted to the cord clamp 248 discussed above with regard to the previous embodiments.

Figure 10:
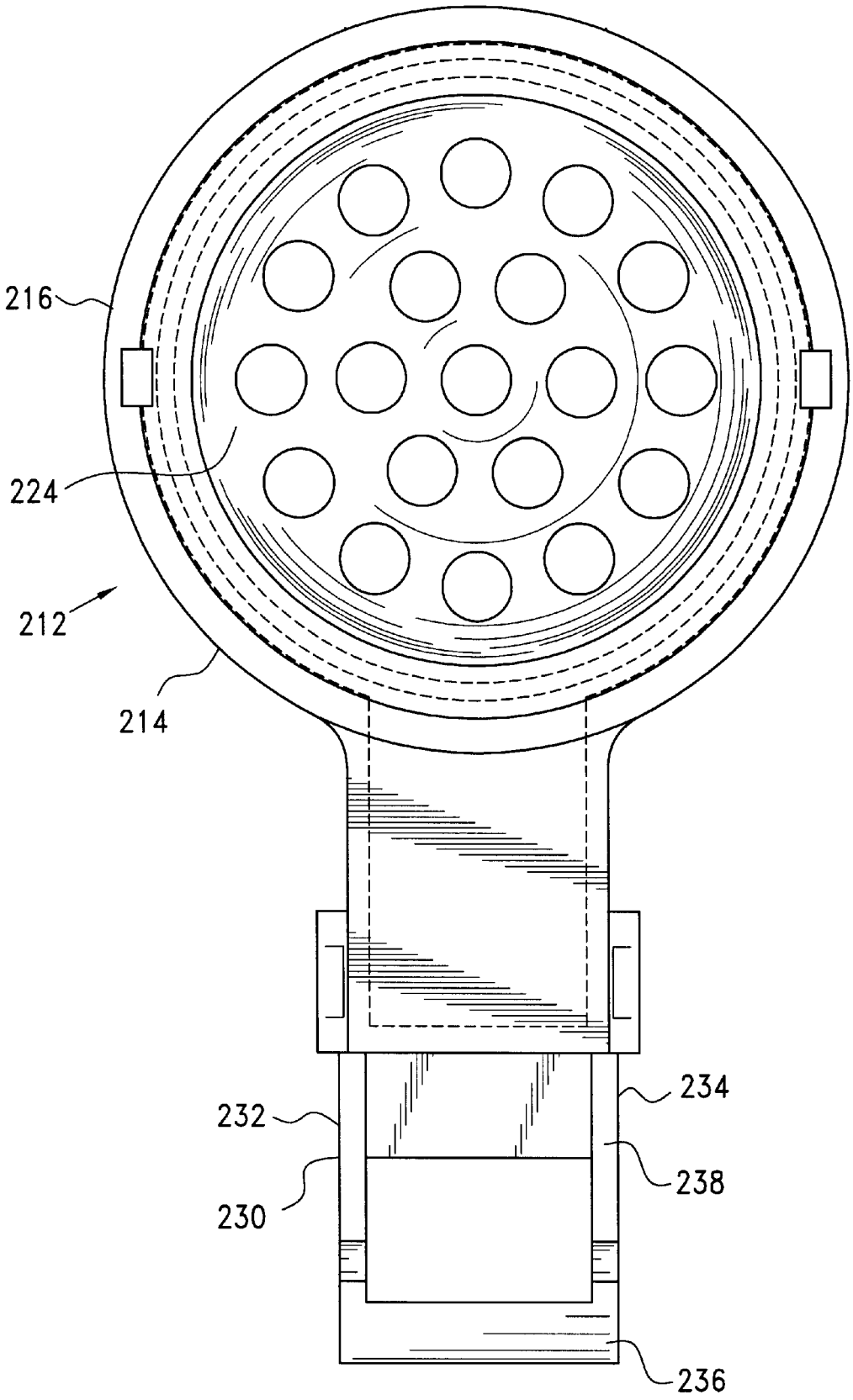
FIG. 10 is a front view of the external ear speaker.
Figure 11:
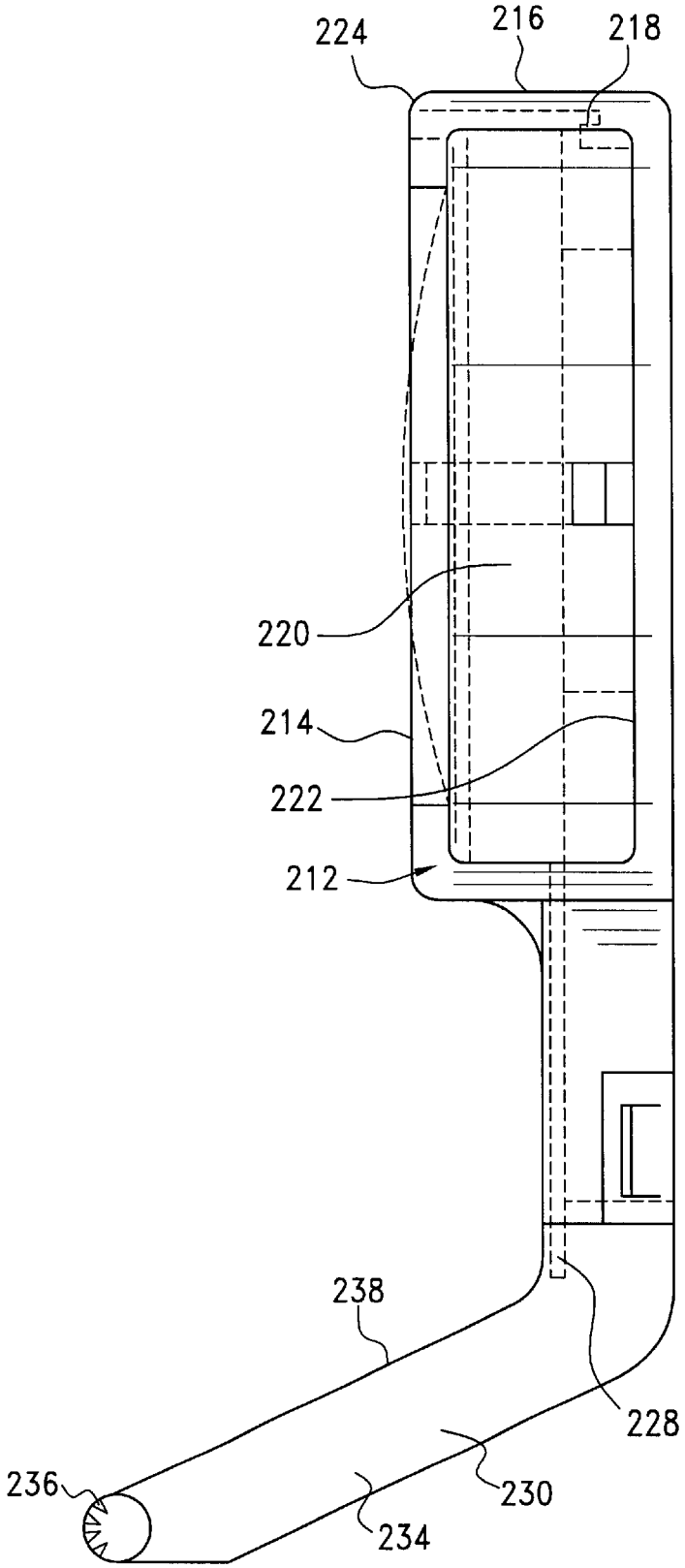
FIG. 11 is a side view of the external ear speaker.

With this in mind, and with reference to FIGS. 10 and 11, the external ear speaker 212 is constructed with a main body 214. The main body 214 includes a first end 216 with a compartment 218 shaped and dimensioned for receiving a speaker driver 220. The compartment 218 is defined by a recess 222 formed in the first end 216 of the main body 214 and a cover 224 shaped and dimensions to fit over the recess 222 in a manner enclosing the speaker driver 220 within the formed compartment 218.

The speaker driver 220 is coupled to a wire 226 communicating with the primary communication system (for example, CB, cellular phone, etc.). As such, the main body 214 is provided with an aperture 228 linking the recess 222 with the exterior of the main body 214. The wire 226 passes through the main body 214 as it exits the compartment 218 in which the speaker driver 220 is housed.

The second end 230 of the main body 214 is provided with first and second arms 232, 234. A pivot bar 236 is positioned between the first and second arms 232, 234 to create a pivot point about which the external ear speaker 212 may pivot when it is secured to the boom microphone device 210.

The pivot bar 236 is shaped and dimensioned to releasably snap into the cord clamp 248. Once snapped into the cord clamp 248, the external ear speaker 212 may be rotated in a manner that will be discussed below in greater detail. Rotation of the external ear speaker 212 is limited by an abutment member 238 secured across the first and second arms 232, 234 at a position limiting the rotation of the external ear speaker 212 toward the auditory canal 240 of the user. The size, shaped and positioning of the abutment member 238 may be readily varied to suit various applications.

As with the embodiments disclosed in FIGS. 1–7, the present embodiment employing the external ear speaker 212 is adapted for use with a series of commonly owned mobile communication devices. For example, the present external ear speaker may be used with the devices disclosed in commonly owned U.S. Pat. Nos. 5,481,077, entitled "Shifter mounted accessory control panel", and U.S. Pat. No. 5,805,985, entitled "Universal adapter kit for mini microphone", as well as other communication devices known within the industry.

The disclosed external ear speaker 212 is completely removable from the ear hook 242 of the boom microphone device 210, and is completely independent of the other functional parts of the microphone device 210. As such, were there is no need for the external ear speaker 212 it may be removed or simply swung back about the pivot bar 236. Furthermore, if the individual wearing the boom microphone device 210 is near other people, and does not want them to hear the conversation, the external ear speaker 212 may be readily attached or rotated to a use position.

The construction of the present external ear speaker 212 aids users in adjusting the speaker for momentary changes in the volume output. For example, some cellular phones have a maximum output level which does not allow listeners to hear very well in a noisy environment. Even when the cellular phone volume is set on maximum, it is often difficult to hear with surrounding noises. In such instances, and with the external ear speaker coupled to the cellular phone, the user may simply pull the external ear speaker 212 toward the auditory canal to adjust for the situation.

Concurrently, when "audio spikes" are encountered, they may distract the user, and even cause harm to the user's ear, if they are not quickly remedied. Most of today's cellular phones do not have a volume control knob which turns like a doorknob, but instead include a push knob which steps the volume level gradually up or down. As a result, volume adjustments take time and are often highly distracting while operating a motor vehicle. The present external ear speaker 212 allows users to quickly and easily swing the speaker out and away from the ear as much as a couple of inches. The user may then proceed with a volume level adjustment as the situation permits. The same can be said for various other two-way radios, computers or other communication devices.

Since it is contemplated that user's will find different speaker positions appropriate for different applications, the pivot bar 236 may be formed with grooves interacting with the clamp 248 to "lock" the speaker 212 in a desired location. In this way, the external ear speaker 212 may swing out incrementally and reliably hold its position.

In addition to the features discussed above, the external ear speaker 212 is designed to keep the auditory canal 240 open to at least some degree at all times. Specifically, the external ear speaker 212 is provided with an abutment member 238 designed to limit the rotation of the external ear speaker 212 toward the auditory canal 240 in a predetermined manner.

In this way, the external ear speaker 212 is engineered to concurrently allow surrounding noises to enter the auditory canal 240. For example, the external ear speaker 212 is designed to permit emergency sounds, for example, horns, sirens, and other alerting sounds, to enter the user's ear while he or she is driving.

In accordance with a preferred embodiment of the present embodiment, most users may expect the external ear speaker 212 to sit no closer the ¾" off of, or away from, the auditory canal 240, and at a 35° angle to the side of the ear and/or meatus. This prevents the external ear speaker 212 from creating a hollow sound in the manner a sea shell causes a hollow sound when held directly adjacent and individual's ear. It is also contemplated that the external ear speaker 212 will have the ability to adjust by pivoting, or swinging, the speaker driver 220 away from the auditory canal 240 by at least 2 inches and position away from the ear at a maximum angle of at least 90 degrees (see FIG. 9).

Figure 12:
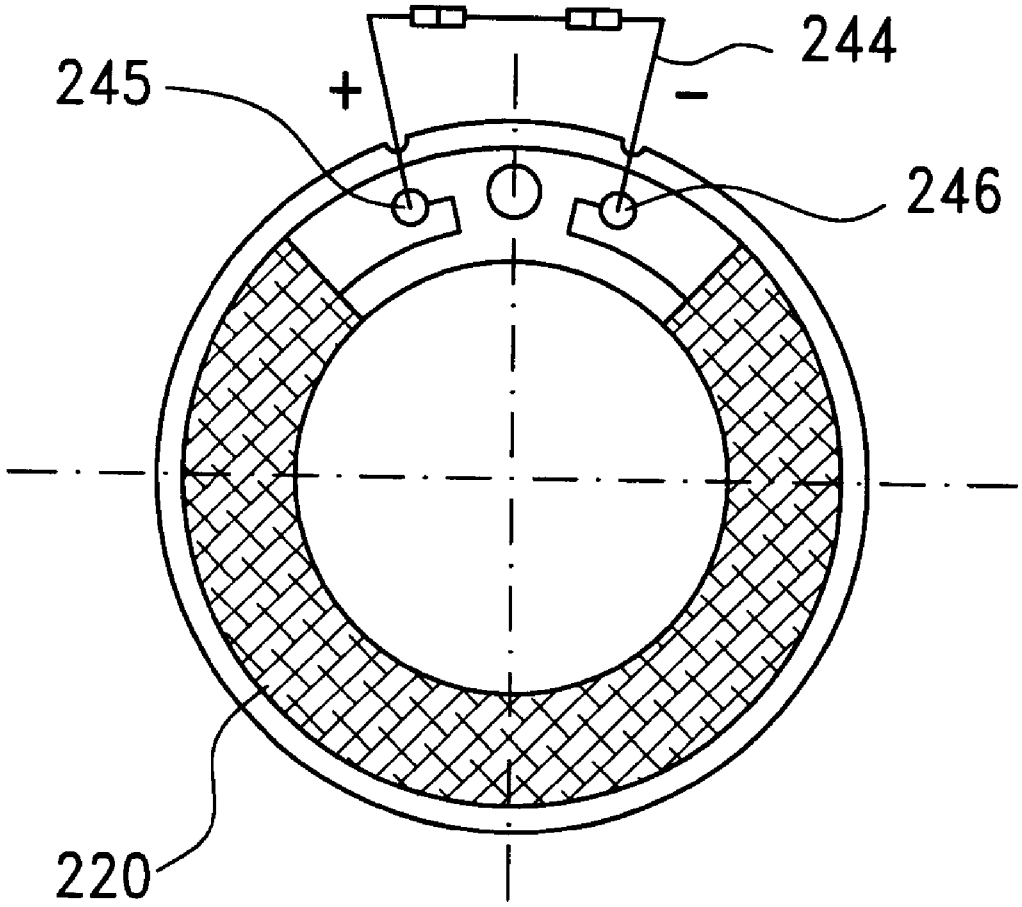
FIG. 12 is a back view of the speaker driver.

In accordance with a preferred embodiment of the present invention, and with reference to FIG. 12, the speaker driver 220 is a very durable dynamic type speaker unit rated at 8 ohms impedance and 1 watt maximum input voltage. For example, Model No. DH-68II, manufactured by Primo Company, has been found to produce highly desirable results.

However, and since different communication devices emit a variety of currents, a voltage limiting and stabilization circuit, such as a varistor 244, is used in combination with 15 the speaker driver 220 to protect the speaker driver 220 from excessive current. Specifically, a silicon varistor 244, preferably a 3.0 volt varistor, is attached at one end to the positive lead 245 of the speaker driver 220 and at its other end to the negative lead 246 of the speaker driver 220.

Use of the 3.0 volt varistor 244 (or combination or series of varistors equivalent to 3.0 volts) permits the passage of the maximum amount of audio input, or forward power, to the speaker driver 220, regardless of the communication device supplying the input signal. In addition, the varistor 244 protects the speaker driver 220 from input power overload, while also allowing it to deliver the highest quality audio the speaker will allow.

While preferred speaker driver and circuit construction are disclosed above, it is understood by those skilled in the art that other speaker drivers and circuit constructions may be employed without departing from the spirit of the present invention.

Figure 14:
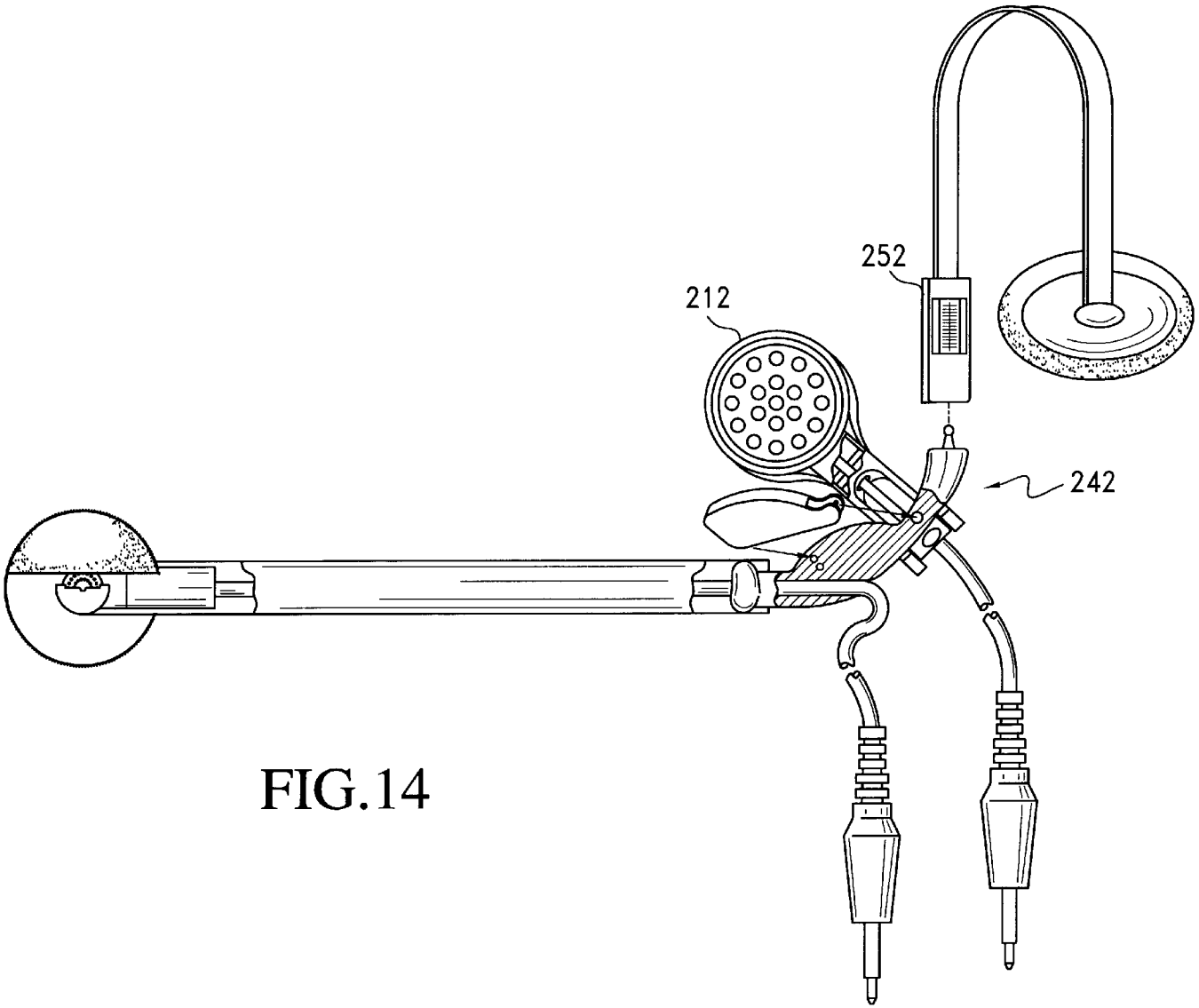
FIG. 14 is a further embodiment of the boom microphone device as disclosed in FIG. 4 with an external ear speaker.

With reference to FIG. 14, the functionality of the present invention may be further enhanced by replacing the upper half 250 of the ear hook 242 with a headband attachment 252. The interchangeable nature of the upper half 250 of the ear hook 242 or headband 252 makes the present invention more universal and helps it appeal to a wider range of consumers.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A head supported communication assembly, comprising:

a head support member shaped and dimensioned to conform to the head of an individual, the head support member further including an ear hook shaped dimensioned to conform to the outer periphery of a human ear so as to support the weight of the head supported communication assembly;

a speaker, pivotally secured to the head support member for unbiased rotation toward and away from the auditory canal of a human ear in a manner limiting rotation of the speaker toward the auditory canal of a human ear in a controlled manner so as to permit a user to selectively swing the speaker away from the auditory canal when there is no need for the speaker, swing the speaker toward the auditory canal when the user wishes to use the speaker or position the speaker at a desired distance from the auditory canal of the user when circumstances so dictate, wherein the speaker includes first and second arm between which a pivot bar positioned, the pivot bar being shaped and dimensioned for selective attachment to clamp formed along the outer surface of the head support member to thereby permit free rotation of the speaker without moving other elements of the assembly, and an elongated microphone boom having a first end and a second end connected to and supported by the head support member.

2. The head supported communication assembly according to claim 1, wherein the speaker includes an abutment member for limiting rotation toward the auditory canal of a human ear.

3. The head supported communication assembly according to claim 2, wherein the abutment member maintains a speaker driver of the speaker at least ¾ inch from the auditory canal.

4. The head supported communication assembly according to claim 1, wherein the head support member includes clamp member shaped and dimensioned to releasably receive the pivot bar.

5. The head supported communication assembly according to claim 1, wherein the head support member is an ear-hook shaped and dimensioned to conform to the outer periphery of a human ear, the ear-hook includes an inner side and an outer side, said inner side of the ear-hook is substantially shaped and dimensioned to conform to the outer periphery of the pinna of a human ear, the ear-hook further comprising an auditory canal seat formed in the inner side and positioned to provide a secure fit between the support member and the auditory meatus of a user's ear.

6. The head supported communication assembly according to claim 5, further including an elongated microphone boom coupled to the ear-hook at a position adjacent the auditory canal seat.

7. The head supported communication assembly according to claim 1, further including an elongated microphone boom having a first end and an opposite second end connected to the head support member.

8. The head supported communication assembly according to claim 1, wherein the speaker includes a speaker driver in combination with a varistor to control the voltage applied across the speaker driver.

* * * * *